United States Patent [19]

Thomas

[11] Patent Number: 4,984,307

[45] Date of Patent: Jan. 15, 1991

[54] TOILET SANITIZER ATTACHMENT

[76] Inventor: Orrett Thomas, 115 Lenox Rd., Apt. E6, Brooklyn, N.Y. 11226

[21] Appl. No.: 507,126

[22] Filed: Apr. 6, 1990

Related U.S. Application Data

[63] Continuation-in-part of Ser. No. 293,996, Mar. 29, 1989, abandoned.

[51] Int. Cl.[5] ..... E03D 9/02
[52] U.S. Cl. ..... 4/225
[58] Field of Search ..... 4/222–226, 4/228

[56] References Cited

U.S. PATENT DOCUMENTS

| | | | |
|---|---|---|---|
| 960,984 | 6/1910 | Melville | 4/225 |
| 3,112,499 | 12/1963 | Thornton | 4/226 X |

FOREIGN PATENT DOCUMENTS

| | | | |
|---|---|---|---|
| 911118 | 7/1949 | Fed. Rep. of Germany | 4/226 |
| 3344938 | 6/1985 | Fed. Rep. of Germany | 4/222 |
| 120753 | 9/1926 | Switzerland | 4/226 |
| 466414 | 5/1937 | United Kingdom | 4/226 |

*Primary Examiner*—Charles E. Phillips
*Attorney, Agent, or Firm*—Collard, Roe & Galgano

[57] ABSTRACT

An attachment for sanitizing a toilet including a branch pipe attached to a flush pipe. The branch pipe housing a sanitizing cartridge cooperating with the branch pipe via key and keyway.

12 Claims, 2 Drawing Sheets

TOILET SANITIZER ATTACHMENT

This is a continuation-in-part of my earlier filed application Ser. No. 293,996, filed Mar. 29, 1989 now abandoned.

The present invention relates to an attachment for use with a toilet for sanitizing the same and, more particularly, it relates to a plumbing attachment for the toilet which includes a sanitation device for sanitizing/deodorizing the water during the flushing of a toilet and maintaining the water in the toilet in a sanitized/deodorized state.

At the present time it is common to sanitize the water in a toilet, whether it be a toilet bowl or a urinal, by the placement in the toilet bowl or urinal of a sanitary/-deodorant type of chemical in solid form which slowly dissolves in the water in the toilet or the urinal. In the case where the flush water for a toilet is contained in a tank, which is drained during the flushing of the toilet, it is also possible to use a similar type of slowly dissolving sanitary/deodorizing substance placed within the tank, so that the water which is stored in the tank between flushing cycles is disinfected, sanitized and deodorized prior to its use for flushing purposes. As is well known, subsequent to the flush a small portion of the flushing water remains in the toilet bowl, which has thus been deodorized and sanitized, prior to the next use of the toilet facility. Certainly the most effective method of sanitizing/deodorizing the water used for flushing, is to subject the water prior to its injection into the toilet bowl to the sanitizing/deodorizing chemical, so that the fecal matter in the toilet bowl is flushed out of the bowl by sanitized water. This occurs in a situation where the sanitizing/deodorizing chemical is allowed to dissolve in a tank filled with water which is used for the flushing of the toilet. However, where a tank is not utilized for storage of the water but rather a flushometer injects water under pressure into the toilet bowl or the urinal, the water is not pretreated chemically. In this situation, chemical sanitizing/deodorizing elements are hung in the toilet or in the urinal. This latter method is inadequate for the proper sanitizing/deodorizing of the flushed water in comparison to the treatment of the flush water prior to the flushing operation since only a portion of the flush water comes into contact with the chemical element during the flush cycle and immediately is flushed out the toilet bowl.

It is, therefore, an object of the present invention to provide a toilet sanitizer/deodorizer attachment for use with tank-less toilets, whereby a sanitizing/deodorizing chemical is added to the flush water prior to its use in flushing the toilet.

The above object is accomplished in accordance with the present invention by the provision of a toilet sanitizer/deodorizer attachment connected between the flushometer for metering the flush water and the plumbing connection to the toilet bowl or urinal, as the case may be. The sanitizer/deodorizer attachment consists of a main pipe or tube connected at a first end to the outlet of the flushometer, and connected at its second end to the plumbing connection to the toilet bowl, a branch pipe is connected to the main pipe to substantially form a Y shape having an open end, a cartridge containing the sanitizer/deodorizer chemical in the form of a semi-solid compound is removably housed in the branch pipe, a feed pipe is connected to the main pipe adjacent to the connection of the main pipe to the flushometer outlet upstream from the connection of the branch pipe to the main pipe and connected to the branch pipe upstream from the cartridge containing chemical, so that a portion of the water released by the flushometer during the flushing operation is diverted into the branch pipe to mix with the semi-solid sanitizer/deodorizer material and then flow back into the main pipe to mix with the flush water passing therethrough, so as to sanitize and deodorize the flush water prior to its entrance into the toilet bowl or urinal. The branch pipe is provided with a sealing cap at its open end which is removable to permit access thereto for the easy removal of a spent sanitizer/deodorizer cartridge and replacement with a fresh one.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
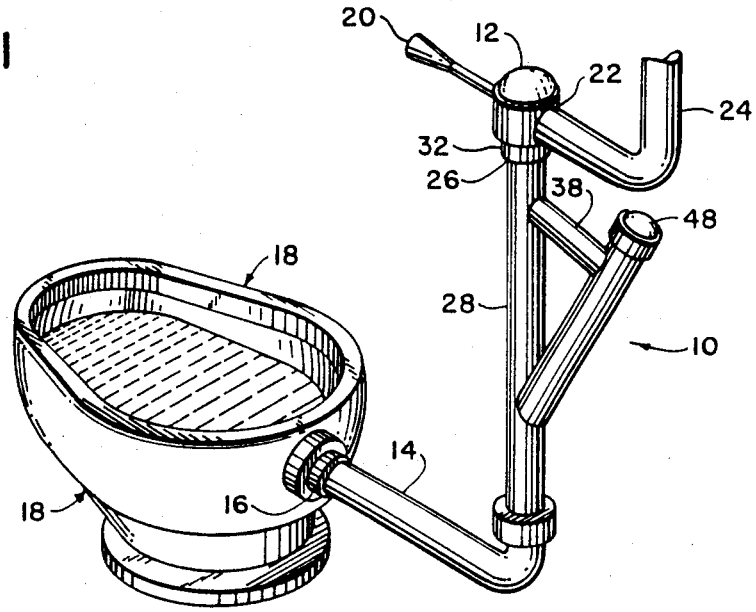
FIG. 1 is a side elevational view of the sanitizer/-deodorizer toilet attachment as seen connected to a toilet bowl.

Now turning to the drawings, there is shown in FIG. 1 a sanitizer attachment, generally designated 10, according to the present invention for sanitizing/deodorizing the flush water for a tank-less toilet or urinal, which is interconnected between a flushometer 12 and an elbow pipe 14, which in turn is connected to the plumbing connection 16 of a toilet bowl 18. The flushometer 12 is a standard flushometer having an operating handle 20, and which is connected at its inlet 22 to the water supply 24. In operation, when handle 20 of flushometer 12 is operated, the valve within flushometer 12 is opened, allowing water from water supply 24 under house pressure to exit from the flushometer at outlet 26, from which it passes through sanitizer attachment 10, elbow 14, plumbing connection 16, and into toilet bowl 18 to flush through the same. According to the design of flushometer 12, when the pressure at outlet 26 has reached a certain level relative to the pressure of the water supply, the valve within flushometer 12 is automatically closed, thus shutting off the flow of water from water supply 24.

Figure 2:
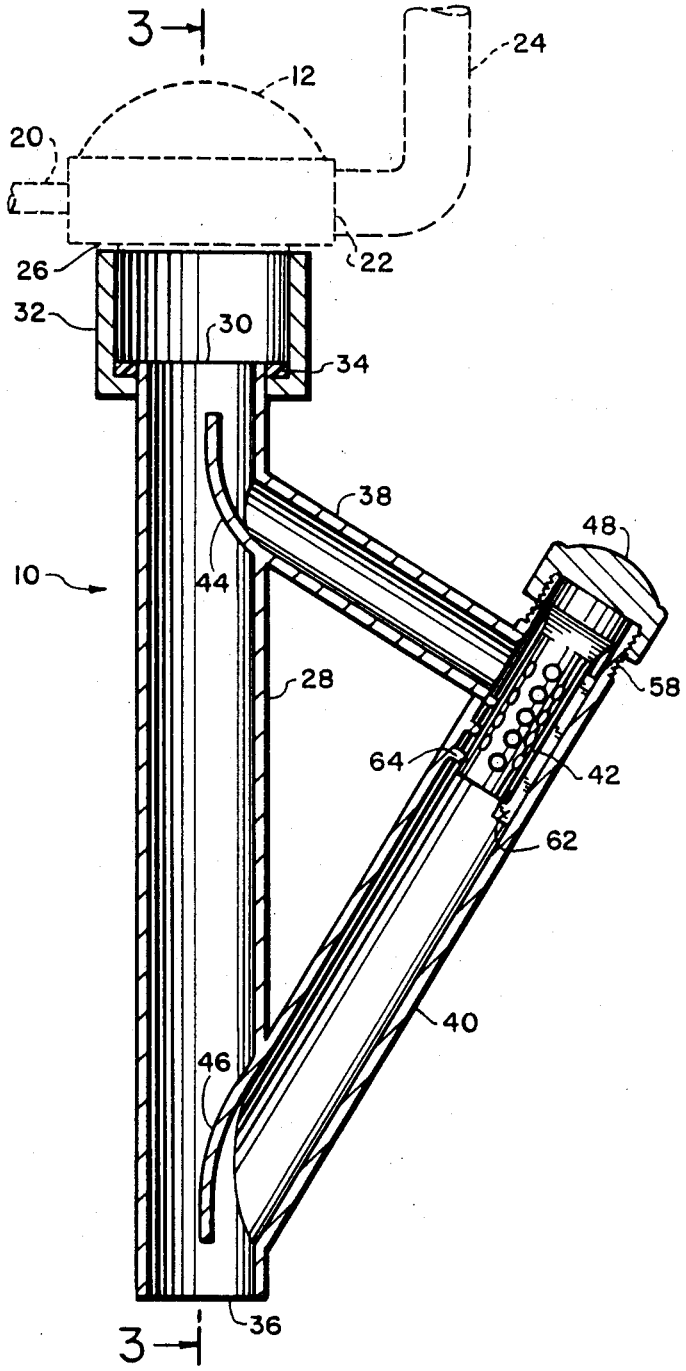
FIG. 2 is a cross sectional view taken in elevation of the toilet sanitizer/deodorizer attachment according to the present invention.
Figure 3:
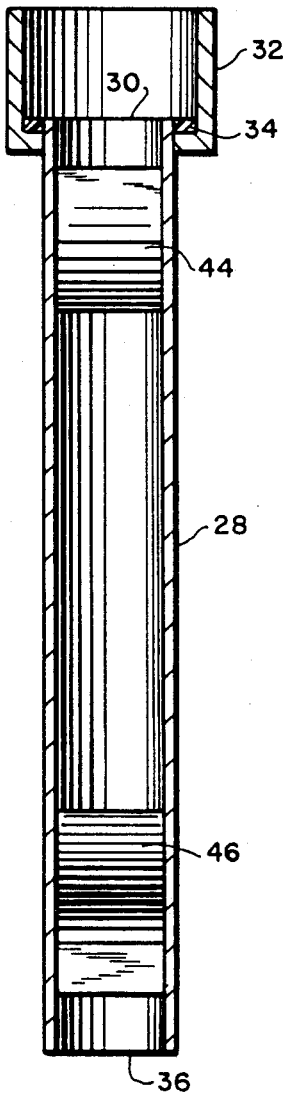
FIG. 3 is a cross sectional view of the sanitizer/-deodorizer attachment of FIG. 2 taken along the line 3—3 of FIG. 2.

As clearly seen in FIG. 2, sanitizer attachment 10 includes a main water pipe or tube, generally designated 28, which is connected at its first or upper end 30 to flushometer 12 (shown in phantom) by means of sealing nut 32, having a sealing washer 34 therein between. The lower end 36 of main pipe 28 may be cut to any length suitable for interconnection with elbow 14 extending from toilet bowl 18. The sanitizer attachment further includes a feed pipe 38 and a branch pipe 40 which interconnect with main pipe 28. As clearly seen, feed pipe 38 interconnects with main pipe 28 at a location which is closely adjacent to the connection of main pipe 28 to flushometer 12, while branch pipe 40 interconnects with main pipe 28 at a location downstream from the connection of feed pipe 38 to main pipe 28. Branch pipe 40 forms essentially a Y configuration with main pipe 28 and is adapted to house a sanitizer/deodorizer cartridge, designated 42, which extends below or downstream from a connection between feed pipe 38 and branch pipe 40. At its intersection with main pipe 28, as clearly seen in FIGS. 2 and 3, feed pipe 38 is provided with an upturned lip 44 adjacent to upper end 30 of pipe 28, and which is adapted to divert approximately two to five percent (2 to 5%) of the water entering pipe 28 from flushometer 12 during the flushing operation. The water thus diverted into feed pipe 38 enters branch pipe 40, where cartridge 42 is housed, to pass therethrough and exit from branch pipe 40 via exit lip 46 to return to main pipe 28. A removable threaded cap 48 is provided at the open end of branch pipe 40 to allow access into branch pipe 40 for the purpose of replacing a used cartridge 42 with a fresh one.

Figure 4:
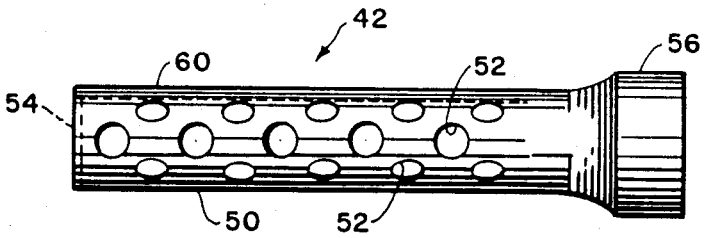
FIG. 4 is a side view of the sanitizer/deodorizer cartridge used in the sanitizer/deodorizer attachment according to the present invention.

As clearly seen in FIG. 4, sanitizer/deodorizer cartridge 42 comprises a cartridge element 50 containing therein a suitable semi-solid sanitizer/deodorizer chemical which is dissolvable in water as the water passes over it, and the exterior of element 50 is provided with a plurality of openings 52 for permitting the water to flow in and out of element 50. At the bottom end of element 50, a screen 54 closes off element 50, so as to retain the semi-solid sanitizer/deodorizer chemical within the element. The upper end of element 50 is provided with a rim 56 which extends outwardly from cylindrically shaped element 50 and is adapted to engage with a retaining lip 58 provided in branch pipe 40 adjacent the interconnection between feed pipe 38 and branch pipe 40. Cartridge 42 is positioned in branch pipe 40 by the engagement of a groove 60 provided in element 50 with a key 62 provided in branch pipe 40. A series of splash buds 64 is also provided on the interior wall of branch pipe 40, so as to permit the water entering into pipe 40 from feed pipe 38 to splash around in pipe 40 and contact and enter cartridge 42, thereby dissolving the sanitizer/deodorizer semi-solid chemical in the cartridge. The water and sanitizer/deodorizer mixture passes through pipe 40 and into main pipe 28, which passage is aided by the vacuum generated at the connection of branch pipe 40 with main pipe 28 by the flush water flow through main pipe 28.

In operation, when handle 20 of flushometer 12 is dislocated to activate the valve within flushometer 12, flush water from water supply pipe 24 is passed under pressure into main pipe 28 of sanitizer attachment 10. A small portion, approximately 2 to 5% of the water passing into main pipe 28 is diverted by lip 44 into feed pipe 38, and from there into branch pipe 40. When the water from feed pipe 38 enters branch pipe 40, it contacts sanitizer/deodorizer cartridge 42, as well as splash pads 64, so that the water is encouraged to pass through openings 52 of element 50 and dissolve the sanitizer/deodorizer semi-solid chemical therein, and the mixture of water and sanitizer/deodorizer chemical is drawn through exit lip 46 of branch pipe 40 by the vacuum created by the flush water passing thereby. Exit lip 46 merges into main pipe 28, so that turbulence is substantially prevented by the mixing of the water from branch pipe 40 and the water passing through main pipe 28 which would otherwise cause a slowing down of the flush water as it passes through main pipe 28. In order to replace cartridge 42 with a fresh cartridge, it is only necessary to unscrew threaded cap 48 from branch pipe 40 and withdraw cartridge 42 by grasping rim 56 and removing the cartridge from pipe 40. Replacement of cartridge 42 with a fresh cartridge is carried out in the reverse manner to removal of the cartridge. Once threaded cap 48 has been replaced on branch pipe 40 and sealed properly, the sanitizer attachment is again ready for use, together with the flush system. It can thus be appreciated that with very minor disruption of the flush flow exiting from a flushometer, the flush water for a toilet bowl or urinal can be very thoroughly sanitized and deodorized prior to being jetted into the toilet bowl or urinal. It should also be noted that sanitizer attachment 10 can be formed by metal, hard plastics, or P.V.C. piping.

While only a single embodiment of the present invention has been shown and described, it will be obvious that many changes and modifications may be made thereunto without departing from the spirit and scope of the invention.

What is claimed is:

1. A sanitizer attachment for use with a tankless toilet bowl or urinal for sanitizing/deodorizing the flush water therefor and wherein the flush water is controlled by a flushometer, said attachment comprising:

(a) a main pipe interconnected between an outlet of the flushometer and a plumbing connection of the toilet bowl or urinal;

(b) a branch pipe having an open end and connected to said main pipe forming therewith a substantially Y-shaped configuration;

(c) a feed pipe connected to said main pipe upstream from the connection of the branch pipe with the main pipe and adjacent the connection of the main pipe to the flushometer outlet;

(d) a replaceable cartridge disposed in said branch pipe downstream from the intersection of said feed pipe with said branch pipe and containing a sanitizer/deodorizer chemical dissolvable in water;

(e) a removable sealed cap for closing and sealing the open end of said branch pipe; and (f) a key extending lengthwise in said branch pipe and mating keyway in said cartridge so that said cartridge is fixedly positioned in said branch pipe.

2. The sanitizer attachment as defined in claim 1, which further includes a retaining lip in said branch pipe, and a rim formed on said sanitizer/deodorizer containing cartridge engageable with said retaining lip, so as to retain said cartridge in position in said branch pipe.

3. The sanitizer attachment as defined in claim 1, which further includes a lip formed on the inside of the main pipe at the intersection of the feed pipe therewith facing said flushometer outlet, so as to divert a portion of the water flowing therefrom into said feed pipe.

4. The sanitizer attachment as defined in claim 3, wherein said lip diverts between 2 and 5% of the flush water released by said flushometer into said feed pipe.

5. The sanitizer attachment as defined in claim 1, which further includes an exit lip formed in said main pipe at the intersection thereof with said branch pipe and facing away from the outlet of said flushometer.

6. The sanitizer attachment as defined in claim 5, wherein said exit lip is arranged in said main pipe so that the water diverted through said feed pipe and said branch pipe converges with the flush water in said main pipe so that minimal disruption thereof results.

7. The sanitizer attachment as defined in claim 1, wherein said replaceable cartridge comprises an elongated perforated cylinder.

8. The sanitizer attachment as defined in claim 1, which further includes a series of splash buds arranged in the wall of said branch pipe circumferentially around said cartridge.

9. The sanitizer attachment as defined in claim 1, wherein said replaceable cartridge includes holes formed in its body.

10. The sanitizer attachment as defined in claim 1, wherein said main pipe, branch pipe, feed pipe, and branch pipe cap are formed of metal.

11. The sanitizer attachment as defined in claim 1, wherein said main pipe, branch pipe, feed pipe, and branch pipe cap are formed of plastic.

12. The sanitizer attachment as defined in claim 1, wherein said main pipe, branch pipe, feed pipe, and branch pipe cap are formed of polyvinal chloride.

* * * * *